US007715762B2

(12) United States Patent
Takayama

(10) Patent No.: US 7,715,762 B2
(45) Date of Patent: May 11, 2010

(54) DEVELOPING APPARATUS AND IMAGE FORMING APPARATUS INCLUDING SAME

(75) Inventor: Takeshi Takayama, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/822,931

(22) Filed: Jul. 11, 2007

(65) Prior Publication Data

US 2008/0025762 A1 Jan. 31, 2008

(30) Foreign Application Priority Data

Jul. 31, 2006 (JP) ..... 2006-209145

(51) Int. Cl.
*G03G 15/08* (2006.01)

(52) U.S. Cl. ..... 399/254; 399/256

(58) Field of Classification Search ..... 399/254, 399/256, 29, 30, 61, 119, 224, 255
See application file for complete search history.

(56) References Cited

U.S. PATENT DOCUMENTS

| | | | | |
|---|---|---|---|---|
| 2004/0179865 | A1* | 9/2004 | Nishiyama | 399/254 |
| 2006/0008281 | A1* | 1/2006 | Matsumoto et al. | 399/27 |
| 2006/0045573 | A1* | 3/2006 | Yamaguchi et al. | 399/254 |
| 2006/0078354 | A1* | 4/2006 | Kubota et al. | 399/254 |
| 2006/0204283 | A1* | 9/2006 | Yasuda | 399/254 |

FOREIGN PATENT DOCUMENTS

| | | |
|---|---|---|
| JP | 04-019771 | 1/1992 |
| JP | 04-24781 | 9/1992 |
| JP | 04-247481 A | 9/1992 |
| JP | 2002-148927 | 5/2002 |
| JP | 2003-50500 A | 2/2003 |

* cited by examiner

*Primary Examiner*—David M Gray
*Assistant Examiner*—Ryan D Walsh
(74) *Attorney, Agent, or Firm*—Nixon & Vanderhye PC

(57) ABSTRACT

In the developing apparatus of the present invention, a first agitating and carrying screw has in its vicinity a toner supply opening, through which toner is supplied, on an upstream side in a direction to which developer is carried, the first agitating and carrying member being provided farther from the developer holder than the second agitating and carrying member. A partition plate which partitions an inside of the developer containing tank so as to form first and second carrying paths includes one or more cuts provided from a center section in a longitudinal direction to an end section on a side where the toner supply opening is provided. Therefore, the developer can be returned from the second carrying path to the first carrying path through a second communicating path and the one or more cuts. Consequently, it becomes possible to shorten a time for uniformly mixing the developer and to improve (i) a developer agitating performance and (ii) a toner charging performance of the developing apparatus. This allows to supply stable toner excellent in electrostatic property.

6 Claims, 6 Drawing Sheets

DEVELOPING APPARATUS AND IMAGE FORMING APPARATUS INCLUDING SAME

This Nonprovisional application claims priority under 35 U.S.C. §119(a) on Patent Application No. 209145/2006 filed in Japan on Jul. 31, 2006, the entire contents of which are hereby incorporated by reference.

FIELD OF THE INVENTION

The present invention relates to a developing apparatus used in an electrophotographic image forming apparatus.

BACKGROUND OF THE INVENTION

An electrophotographic image forming apparatus such as a copying machine and a printer has been known conventionally. The electrophotographic image forming apparatus forms a static latent image on a surface of a toner image holder, and develops this static latent image with toner provided by a developing apparatus. Then, the electrophotograpic image forming apparatus transfers and fixes thus obtained toner image onto a recording medium such as a sheet of paper.

Some image forming apparatuses employ a developer made of a toner and a carrier. In each of such image forming apparatuses, a developer made of a toner and a carrier is agitated and circulated. As a result, particles in the developer rob each other and the developer is triboelectrically charged. The triboelectrically charged toner is attracted to a static latent image formed on the toner image holder due to static suction power of the static latent image and forms a toner image, at a developing stage. Recently, because a higher speed is required for image formation, it becomes necessary to supply developer speedily and properly. In order to sufficiently and speedily agitate and transfer developer, for example, Patent Document 1 (Japanese Unexamined Patent Publication 247481/1992 (Tokukaihei 247481), published on Sep. 3, 1992) discloses an electrophotographic developing apparatus including a partition plate with comb-shaped cuts (communicating section) which partition plate is provided between developer agitating mechanisms arranged in two lines in a developer container. The developer agitating mechanisms transfer the developer in directions opposing to each other.

However, in an arrangement disclosed in Patent Document 1, the cut is provided on the partition plate not only to an upstream side of the developer agitating mechanism farther from a developing roller but also to a downstream side of this developer agitating mechanism. This causes toner to flow into a developer agitating mechanism closer to the developing roller through the cut on the downstream side of the developer agitating mechanism farther from the developing roller, before the toner is sufficiently agitated. As a result, toner that is not sufficiently charged is supplied to the developing roller. In this way, the electrophotographic developing apparatus has a poor developer agitating performance and, thereby, a poor toner charging performance. Consequently, the toner is unevenly charged. This prevents high quality image development from being performed. Moreover, because there exist a plurality of developer circulating paths, particularly, a plurality of developer paths for supplying the developer to the developing roller, an amount of the developer supplied to the developing roller varies depending on a position. This causes a problem that image formation having even toner concentration cannot be carried out.

SUMMARY OF THE INVENTION

The present invention is attained in view of the problems mentioned above. An object of the present invention is to realize a developing apparatus capable of (i) shortening a time for evenly mixing particles of a developer and (ii) providing electrically stable toner excellent in electrostatic property by improving developer agitating performance and toner charging performance of the developing apparatus.

In order to achieve the object mentioned above, a developing apparatus of the present invention includes: a developer containing tank, which contains developer containing toner and includes an opening facing an image holder, in which developer containing tank a developer holder is rotatably provided at a position facing the opening; first and second agitating and carrying members provided parallel to the developer holder in the developer containing tank, the first and second agitating and carrying members agitating and carrying the developer in directions opposite to each other; and a partition member, provided between the first and the second agitating and carrying members, which partitions an inside of the developer containing tank so as to form (i) a first carrying path where the first agitating and carrying member carries the developer and (ii) a second carrying path where the second agitating and carrying member carries the developer, the first and second carrying paths communicating each other through communicating paths provided at end sections of the first and second carrying paths, and circulating the developer between the first and second carrying paths, the first agitating and carrying member having in its vicinity a toner supply opening, through which toner is supplied, on an upstream side in a direction to which the first agitating and carrying member carries the developer, the first agitating and carrying member being provided farther from the developer holder than the second agitating and carrying member, the partition member including one or more communicating openings, provided from a center section in a longitudinal direction to an end section on a side where the toner supply opening is provided, which communicating opening returns the developer from the second carrying path to the first carrying path, and the developer being returned from the second carrying path to the first carrying path, through the communicating path and the one or more communicating openings.

According to the arrangement, toner is supplied to an upstream side of the first agitating and carrying member, which is provided farther from the developer holder, in the direction to which the first agitating and carrying member carries the developer. The developer containing the toner supplied is carried in the first carrying path by the first agitating and carrying member. Then, the developer is carried to the second carrying path through the communicating path provided on the downstream side of the first agitating and carrying member. Subsequently, the developer is agitated and supplied to the developer holder by the second agitating and carrying member. The developer left after the supplying of the developer to the developer holder is returned to the first carrying path through the communicating path on the upstream side of the first agitating and carrying member and the one or more communicating openings provided on the partition member from a center section in a longitudinal direction to an end section on a side where the toner supply opening is provided. In this way, the developer circulates between the first and second carrying paths. At this time, the developer does not flow into the second carrying path on the way of the first carrying path and passes all the way through the first carrying path. This is because the partition plate is not provided with a communicating path for the developer from the center section to the downstream side of the first carrying path. After being sufficiently agitated in the first and second carrying paths, the developer is returned to the first carrying path through a plurality of paths including the communicating path and the one or more communicating openings.

Therefore, the aforesaid arrangement makes it possible to shorten a time for uniformly mixing the developer. Consequently, it becomes possible to improve developer agitating performance of the developing apparatus, and, thereby, to improve toner charging performance thereof. This allows to provide stable toner excellent in electrostatic property.

Here, a surface of the developer on a side where the second agitating and carrying member supplying the developer to the developer holder is provided normally tends to become higher than a surface of the developer on a side where the first agitating and carrying member is provided. Accordingly, the arrangement provided with a plurality of paths for returning the developer from the second carrying path to the first carrying path can more effectively suppress a surplus supply of the developer to the developer holder, compared with an arrangement provided with a plurality of paths for supplying the developer from the first carrying path to the second carrying path. This can realize image development in which a stable image quality is maintained.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a side view of a partition plate included in the developing apparatus.

FIG. 5(*b*) is a schematic diagram of a second carrying screw included in the developing apparatus.

FIG. 6(*b*) is a diagram illustrating an output waveform of a sensor at supply of toner to the developing apparatus of the Comparative Example.

DESCRIPTION OF THE EMBODIMENTS

An embodiment of the present invention is explained below with reference to drawings. First, explained is an image forming apparatus of the present embodiment which image forming apparatus includes a developing apparatus of the present embodiment. Subsequently, the developing apparatus is explained in details.

(1. Image Forming Apparatus)

Figure 2:
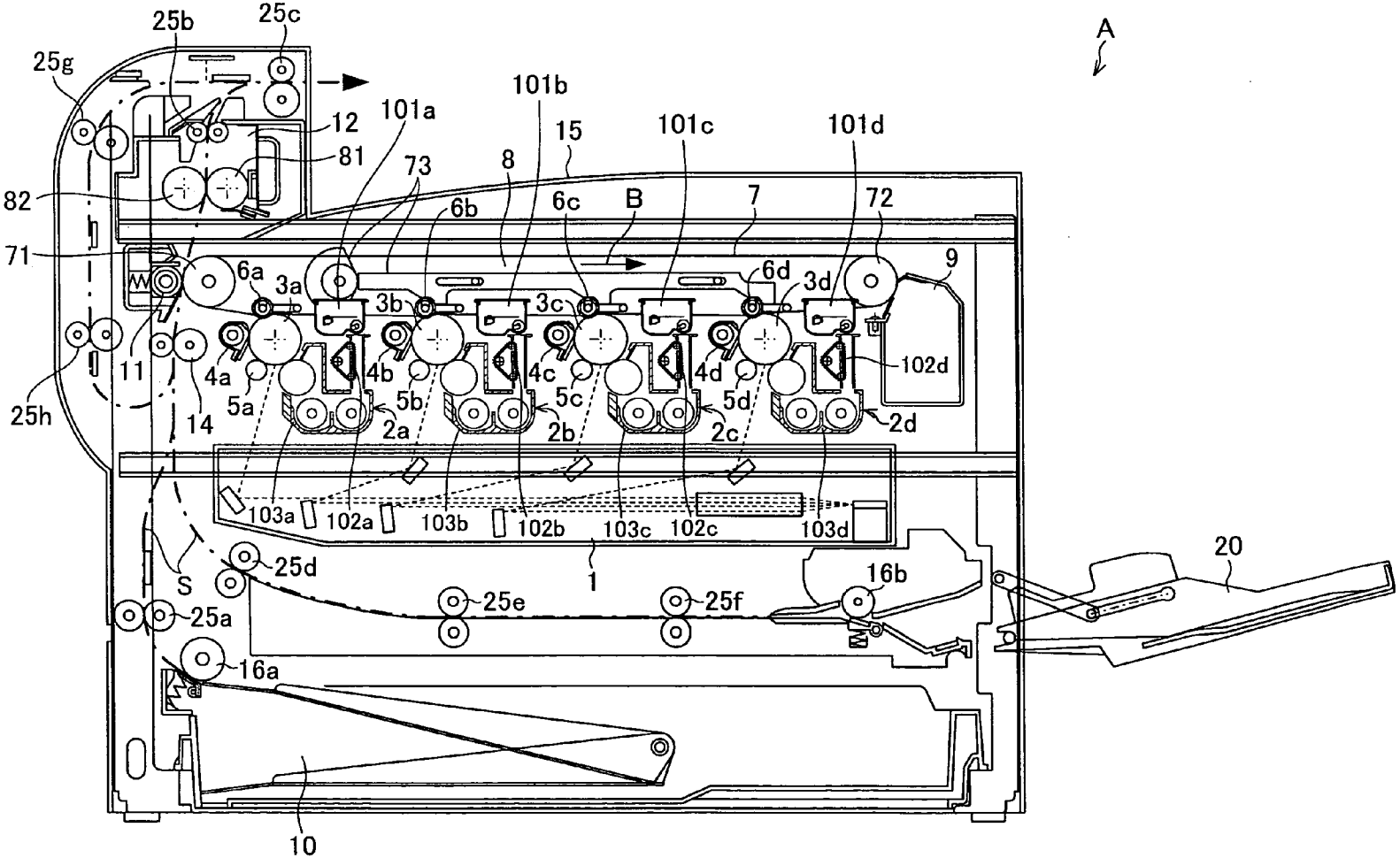
FIG. 2 is an explanatory diagram illustrating an arrangement of an image forming apparatus including the developing apparatus.

FIG. 2 is an explanatory diagram illustrating an arrangement of an image forming apparatus A of the present embodiment. The image forming apparatus A forms a multicolor image and a single color image on a predetermined sheet (recording medium) according to image data transmitted externally.

As illustrated in FIG. 2, the image forming apparatus A includes an exposure unit 1, developing units 2, photoreceptor drums 3, electrical charging units 5, cleaning units 4, an intermediate transfer belt unit 8, a fixing unit 12, a sheet feeding path S, a paper feed tray 10, a paper output tray 15, and the like.

Image data of a color image which the image forming apparatus A deals with is in accordance with a color image using black (K), cyan (C), magenta (M), and yellow (Y). Therefore, the image forming apparatus A includes four developing units 2 (2*a*, 2*b*, 2*c*, and 2*d*), four photoreceptor drums 3 (3*a*, 3*b*, 3*c*, and 3*d*), four electrical charging units 5 (5*a*, 5*b*, 5*c*, and 5*d*), and four cleaning units 4 (4*a*, 4*b*, 4*c*, and 4*d*) so as to form four kinds of latent images corresponding to respective colors. Each of the reference numerals a, b, c, and d corresponds to each color as follows: a to black; b to cyan; c to magenta; and d to yellow. Four image stations are constituted by the aforesaid means distinguished by the reference numerals.

In each image station, the photosensitive drum 3 is provided at an upper part of the image forming apparatus A. The electrical charging unit 5 evenly charges a surface of the photosensitive drum 3 to a predetermined potential. This electrical charging unit 5 may employ, for example, a contact brush-type charger, a non-contact corotron charger or a non-contact scorotron charger, other than a contact roller-type charger as illustrated in FIG. 2.

The exposure unit 1 may employ a technique using, for example, an EL or LED write head provided with light emitting elements arranged in an array, other than a technique using a laser scanning unit (LSU) that includes a laser irradiating section and a reflection mirror as illustrated in FIG. 2. The exposure unit 1 exposes, in accordance with inputted image data, the photoreceptor drum 3 which is charged, and forms a static latent image on a surface of the photoreceptor drum 3 in accordance with the image data.

In each image station, the developing unit 2 visualizes the static latent image formed on the photoreceptor drum 3 with K, C, M, or Y toner. The developing unit 2 includes a toner hopper (toner containing tank) 101 (101*a*, 101*b*, 101*c*, or 101*d*), a toner transfer mechanism 102 (102*a*, 102*b*, 102*c*, or 102*d*), and a developing apparatus 103 (103*a*, 103*b*, 103*c*, or 103*d*). The toner hopper 101 is provided to an upper side in vertical direction with respect to the developing apparatus 103 and stores unused toner (toner powder). Toner is supplied from this toner hopper 101 to the developing apparatus 103 via the toner transfer mechanism 102.

The cleaning unit 4 removes and collects residual toner left on the surface of the photoreceptor drum 3 after a developing process or an image transfer process.

An intermediate transfer belt unit 8 is provided to an upper side of the photoreceptor drum 3. This intermediate transfer belt unit 8 includes intermediate transfer rollers 6 (6*a*, 6*b*, 6*c*, and 6*d*), an intermediate transfer belt 7, an intermediate transfer belt driving roller 71, an intermediate transfer belt driven-roller 72, an intermediate transfer belt tension mechanism 73, and an intermediate transfer belt cleaning unit 9.

The intermediate transfer rollers 6, the intermediate transfer belt driving roller 71, the intermediate transfer belt driven-roller 72, and the intermediate transfer belt tension mechanism 73 suspends the intermediate transfer belt 7 in a tensioned state, and drives the intermediate transfer belt 7 so that the intermediate transfer belt 7 rotates in a direction of an arrow B in FIG. 2.

Each of the intermediate transfer rollers 6 is rotatably supported by an intermediate transfer roller setting section in the intermediate transfer belt tension mechanism 73 of the intermediate transfer belt unit 8. The intermediate transfer roller 6 provides a transfer bias to the intermediate transfer belt 7, which transfer bias is provided for transferring a toner image on the photoreceptor drum 3 to the intermediate transfer belt 7.

The intermediate transfer belt 7 is provided so as to be in contact with each of the photosensitive drums 3. Each color toner image formed on the photoreceptor drum 3 is transferred sequentially onto the intermediate transfer belt 7 so as to be superimposed. As a result, a color image (multi toner image) is formed on the intermediate transfer belt 7. This intermediate transfer belt 7 is made of a film having a thickness of, for example, approximately 100 μm to 150 μm so as to have no end.

The transfer of the toner image from the photoreceptor drum 3 to the intermediate transfer belt 7 is carried out by the intermediate transfer roller 6 in contact with a back surface of the intermediate transfer belt 7. A high voltage transfer bias (a high voltage having polarity (+) opposite to polarity (−) of charge of the toner) is applied to the intermediate transfer roller 6 so that the toner image is transferred. The intermediate transfer roller 6 is produced by using a metal bar (for example, stainless steel bar) having a diameter of, for example, 8 mm to 10 mm as a base. A surface of the intermediate transfer roller 6 is covered with a conductive elastic material (for example, EPDM, or urethane foam). This conductive elastic material allows the intermediate transfer roller 6 to evenly apply the high voltage to the intermediate transfer belt 7. In this embodiment, a roller-shaped member (intermediate transfer roller 6) is used as a transfer electrode. Other than the roller-shaped member, a brush-shaped member or the like can be used as the transfer electrode.

As mentioned above, each static latent image on the photoreceptor drum 3 is visualized with toner corresponding to each hue and becomes a toner image. The toner images are superimposed on the intermediate transfer belt 7. The superimposed toner images are carried by rotation of the intermediate transfer belt 7 to a position where the intermediate transfer belt 7 comes into contact with a fed sheet. The transfer roller 11 provided at this position transfers the images onto the sheet. In this case, the intermediate transfer belt 7 and the transfer roller 11 press each other at a predetermined nip width. Moreover, a voltage is applied to the transfer roller 11 so that the toner images are transferred onto the sheet. This voltage is a high voltage of polarity (+) opposite to polarity (−) of charge of the toner.

For the purpose of constantly obtaining the predetermined nip width, the transfer roller 11 or the intermediate transfer belt driving roller 71 is made of a hard material such as metal. The other one of the rollers 11 and 71 is, for example, an elastic roller, and made of a soft material (for example, elastic rubber, or expandable resin).

Toner left on the intermediate transfer belt 7 will become a cause of toner color mixture in a subsequent process. Such toner includes (i) toner adhering to the intermediate transfer belt 7 due to a contact between the intermediate transfer belt 7 and the photosensitive drums 3 and (ii) residual toner on the intermediate transfer belt 7 which toner is not transferred to a sheet from the intermediate transfer belt 7 at the transfer of the toner images. Accordingly, such toner is removed and collected by the intermediate transfer belt cleaning unit 9. The intermediate transfer belt cleaning unit 9 includes, for example, a cleaning blade as a cleaning member in contact with the intermediate transfer belt 7. The intermediate transfer belt 7 is supported from a back surface thereof by the intermediate transfer belt driven roller 72 at a position where this cleaning blade comes into contact with the intermediate transfer belt 7.

The paper feed tray 10 stores a sheet used in image formation, for example, recording paper. The paper feed tray 10 is provided below an image forming section and the exposure unit 1. The paper output tray 15 is provided on the top of the image forming apparatus A. A printed sheet is placed face down here on the paper output tray 15.

Moreover, the image forming apparatus A includes a sheet feeding path S. The sheet feeding path S sends a sheet in the paper feed tray 10 and a sheet in a manual paper feed tray 20 to the paper output tray 15 via a transfer section (a section where the intermediate transfer belt driving roller 71 and the transfer roller 11 face each other) and a fixing unit 12. Pick-up rollers 16, a resist roller 14, the transfer section including the transfer roller 11, the fixing unit 12, sheet feeding rollers 25 (25*a*, 25*b*, 25*c*, 25*d*, 25*e*, 25*f*, 25*g*, and 25*h*), and the like are provided on the sheet feeding path S from the paper feed tray 10 to the paper output tray 15.

Each of the sheet feeding rollers 25 is a compact roller for encouraging and assisting the sheet feeding operation. A plurality of the sheet feeding rollers 25 are provided along the sheet feeding path S. The pick-up roller 16 is provided to an end section of the paper feed tray 10. The pick-up roller 16 picks up a sheet one by one from the paper feed tray 10 so as to feed the sheet to the sheet feeding path S. The resist roller 14 temporarily holds the sheet being fed through the sheet feeding path S and feeds the sheet to the transfer section at a timing at which a top of the toner images on the photoreceptor drum 3 comes together with a top of the sheet.

The fixing unit 12 includes a heat roller 81, a pressure roller 82, and the like. The heat roller 81 and the pressure roller 82 pinch a sheet therebetween and rotate. The heat roller 81 is controlled by a controlling section (not shown) so as to have a predetermined fixing temperature. The controlling section controls the heat roller 81 in accordance with a detection signal from a temperature detector (not shown). The heat roller 81 heats and presses the sheet together with the pressure roller 82. This fuses, mixes, and presses the color toner images transferred onto the sheet and fixes on the sheet with heat. A sheet on which a multi color toner image (color toner image) is fixed is carried through the sheet feeding path S by a plurality of sheet feeding rollers 25. Then, the sheet (the sheet having the multi color toner image facing down) is outputted face down to the paper output tray 15.

Next explained is a sheet feeding operation through the sheet feeding path S. The image forming apparatus A, as explained above, is provided with the paper feed tray 10 storing sheets beforehand and the manual paper feed tray 20 used, for example, in a case where a small number of sheets are subjected to printing. The pick-up rollers 16 (16*a* and 16*b*) are provided to the paper feed trays 10 and 20, respectively. Each of these pick-up rollers 16 supplies a sheet one by one to the sheet feeding path S.

In the case of single side printing, the sheet fed from the paper feed tray 10 is fed to the resist roller 14 by a pair of the sheet feeding rollers 25*a* on the sheet feeding path S. Then, the sheet is fed to the transfer section by the resist roller 14 at a timing at which a top of the sheet comes together with the top of the toner images superimposed on the intermediate transfer belt 7. The transfer section transfers the toner images onto the sheet. The toner images are fixed onto the sheet at the fixing unit 12. Subsequently, the sheet passes between a pair of the sheet feeding rollers 25*b* and is outputted onto the paper output tray 15 from a pair of the sheet feeding rollers (paper output rollers) 25*c*.

The sheet fed from the manual paper feed tray 20 is fed to the resist roller 14 by a plurality of pairs of the sheet feeding rollers 25 (25*f*, 25*e*, and 25*d*). Thereafter, the sheet is outputted onto the paper output tray 15 after passing through the same path as the sheet fed from the paper feed tray 10.

In the case of double side printing, after the single side printing is completed, a rear end of the sheet having passed through the fixing unit 12 is chucked by the pair of the paper output rollers 25*c*. Then, the sheet is lead to pairs of the sheet feeding rollers 25*g* and 25*h* by counterrotation of the pairs of the paper output rollers 25*c*. After the sheet passes through the resist roller 14 and is subjected to back side printing, the sheet is outputted to the paper output tray 15.

(2. Structure of Developing Apparatus)

Figure 3:
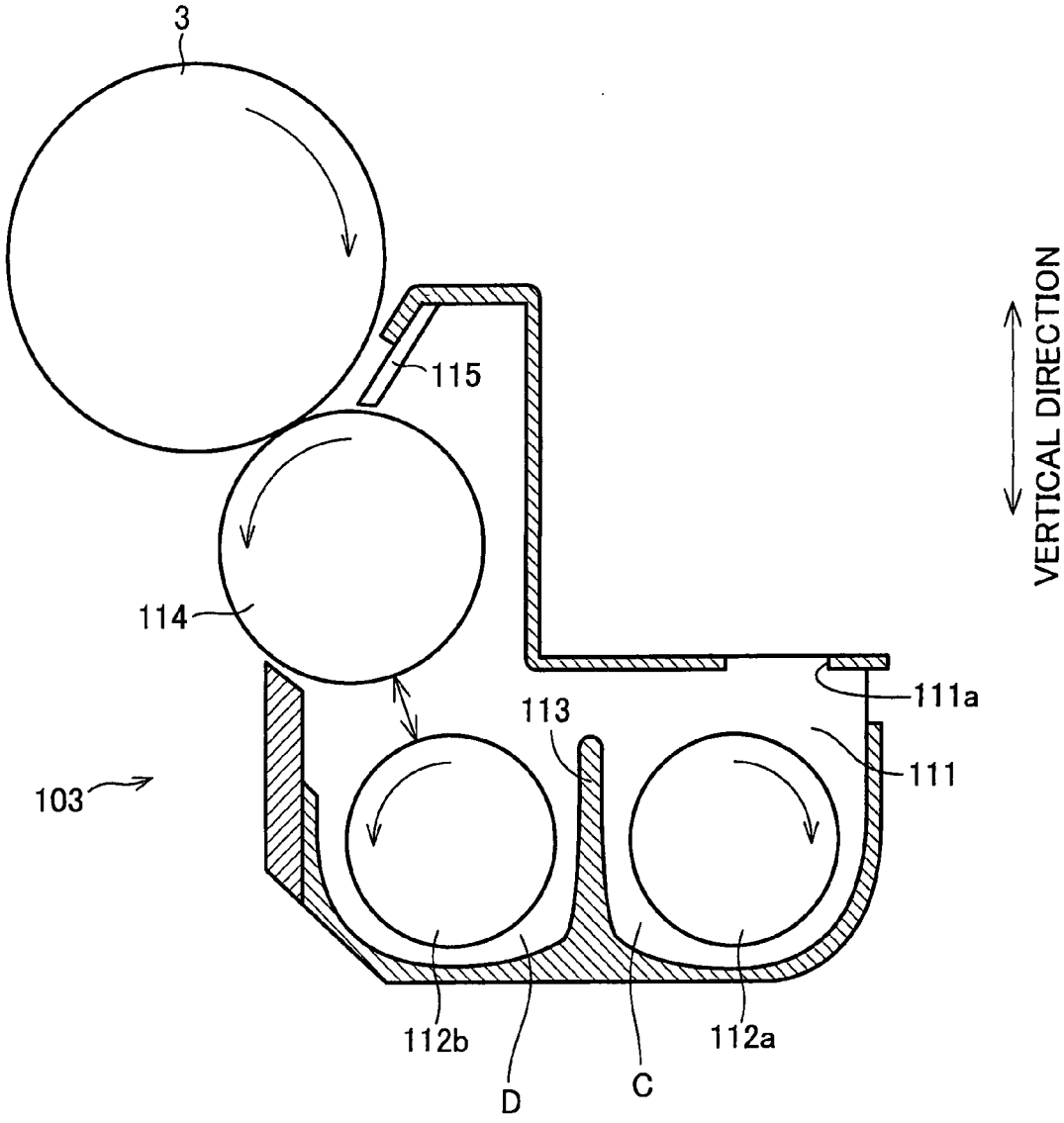
FIG. 3 is a schematic diagram illustrating the developing apparatus viewed in a horizontal direction.

Next, the developing apparatus 103 included in the image forming apparatus A is explained in details. FIG. 3 is a schematic diagram of the developing apparatus 103 viewed in a horizontal direction. The developing apparatus 103 is provided so as to face the photoreceptor drum 3. The developing apparatus 103 provides toner onto a surface of the photoreceptor drum 3 and visualizes a static latent image formed on the surface of the photoreceptor drum 3.

Figure 1:
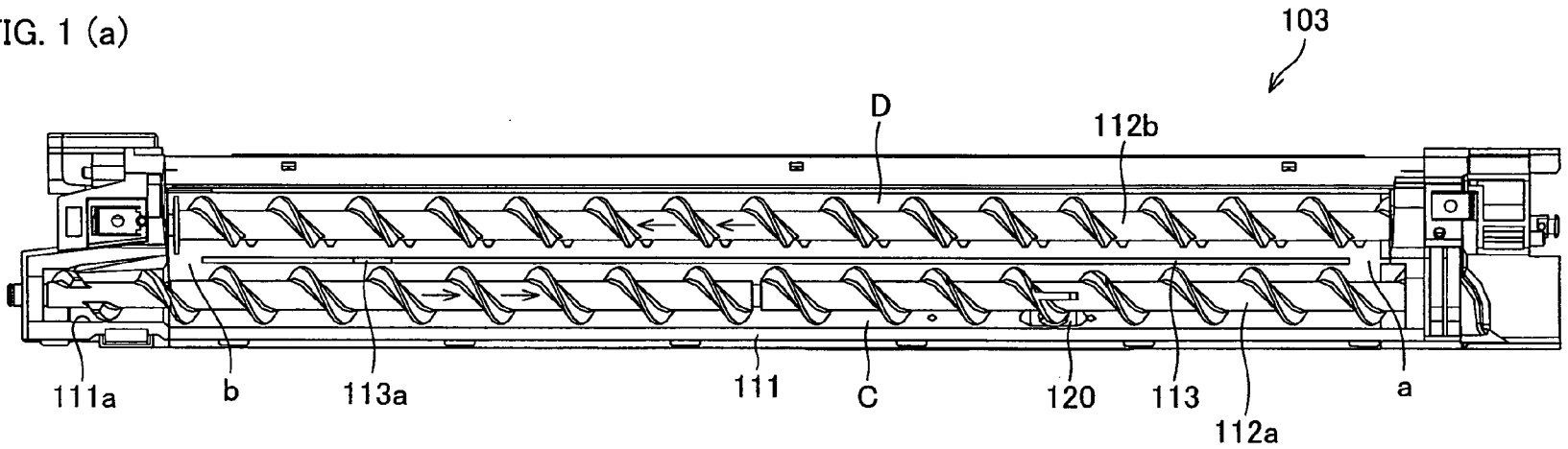
FIG. 1(*a*) is a schematic diagram illustrating an inside of a developer containing tank of a developing apparatus viewed from an upper side in a vertical direction in one embodiment of the present invention.
Figure 1:
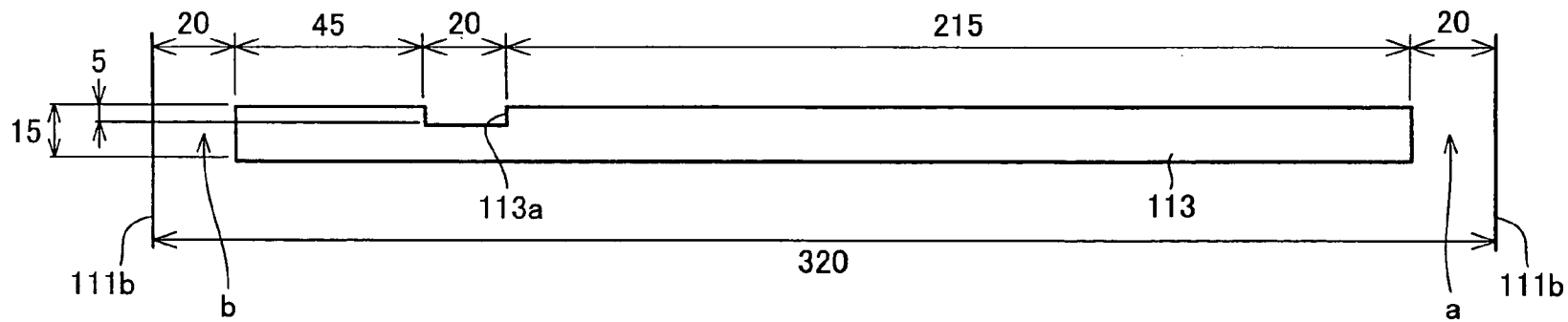

As illustrated in FIG. 3, the developing apparatus 103 includes a developer containing tank 111, a developing roller 114, a blade 115, a first carrying screw 112*a*, a second carrying screw 112*b*, and a partition plate (partition member) 113. FIG. 1(*a*) is a schematic diagram illustrating an inside of the developer containing tank 111 of the developing apparatus 103 viewed from an upper side in a vertical direction. The developing roller 114 is not shown in FIG. 1(*a*).

The developer containing tank 111 is a tank containing a two-component-type developer made of a toner and a carrier. As illustrated in FIG. 3 and FIG. 1(*a*), a toner supply opening 111*a* is formed on an upper side of an upstream side of the first carrying screw 112*a* in the developer containing tank 111. In the present embodiment, as illustrated in FIG. 1(*a*), one end (left end in FIG. 1(*a*)) in a rotation axis direction is assumed to be an upstream side and the other end (right end in FIG. 1(*a*)) is assumed to be a downstream side.

As illustrated in FIG. 3, the developing roller 114 is a magnet roller which is provided in a position facing the photoreceptor drum 3 so as to be close to the photoreceptor drum 3. The developing roller 114 is set to be rotated in a direction opposite to a rotation direction of the photoreceptor drum 3. This developing roller 114 supplies toner in the developer containing tank 111 to the photoreceptor drum 3. A blade (doctor blade) 115 for regulating a layer thickness is provided at a position close to a periphery of the developing roller 114.

As illustrated in FIG. 1(*a*), each of the first carrying screw 112*a* and the second carrying screw 112*b* includes an agitating wing for agitating and carrying the developer. Each of the first and second carrying screws 112*a* and 112*b* is a screw-shaped roller (agitating roller) that is rotated by driving means (not shown) such as a motor. As illustrated in FIG. 1(*b*), the first and second carrying screws 112*a* and 112*b* are provided in parallel so that periphery surfaces of the first and second carrying screws 112*a* and 112*b* face each other via the partition plate 113. Moreover, the first and second carrying screws 112*a* and 112*b* are set so as to rotate in directions opposite to each other. A distance between the second carrying screw 112*b* and the developing roller 114 is from 3 mm to 7 mm.

The partition plate 113 is provided so as to extend in parallel in a rotation axis direction of the first carrying screw 112*a* and the second carrying screw 112*b*. This partition plate 113 partitions the inside of the developer containing tank 111 so as to form (i) a first carrying path C provided with the first carrying screw 112*a* and (ii) a second carrying path D provided with the second carrying screw 112*b*.

Because the second carrying path D is provided close to the developing roller 114, the second carrying path D is narrower to some extent than the first carrying path C. A surface of the developer in the second carrying path D is higher than that of the first carrying path C.

Moreover, as illustrated in FIG. 1(*b*), the partition plate 113 is provided so that end sections thereof in a longitudinal direction are away from respective surfaces of side walls 111*b* of the developer containing tank 111. (The side walls 111*b* are at ends of each of the first carrying path C and the second carrying path D in a longitudinal direction thereof.) This forms communicating paths communicating between the first carrying path C and the second carrying path D at positions in the vicinity of end sections of the partition plate 113 in the longitudinal direction thereof. In the present embodiment, as illustrated in FIG. 1(*a*), a communicating path formed in the vicinity of an end section of the partition plate 113 on the downstream side of the first carrying screw 112*a* is referred to as a first communicating path a. On the other hand, a communicating path formed in the vicinity of an end section of the partition plate 113 on the upstream side of the first carrying screw 112*a* is referred to as a second communicating path b.

Furthermore, as illustrated in FIG. 1(*b*), the partition plate 113 has a cut (communicating opening) 113*a*. This cut 113*a* is provided on the partition plate 113 from a center section to an end section on a side where the toner supply opening 111*a* is provided in a longitudinal direction of the partition plate 113. This cut 113*a* communicates the developer from the second carrying screw 112*b* to the first carrying screw 112*a*.

In the present embodiment, as illustrated in FIG. 1(*b*), the partition plate 113 has an entire length of 320 mm in a longitudinal direction thereof and a height of 15 mm. One cut 113*a* is provided on the partition plate 113 so as to have a width of 20 mm from a position 45 mm from an end section (an end section on the upstream side of the first carrying screw 112*a*) of the partition plate 113 on the side where the toner supply opening 111*a* is provided. Moreover, the cut 113*a* has a depth of 5 mm in a vertical direction. These numeral values concerning the partition plate 113 and the cut 113*a* are merely examples, and by no means specifically limit the present invention.

Figure 4:
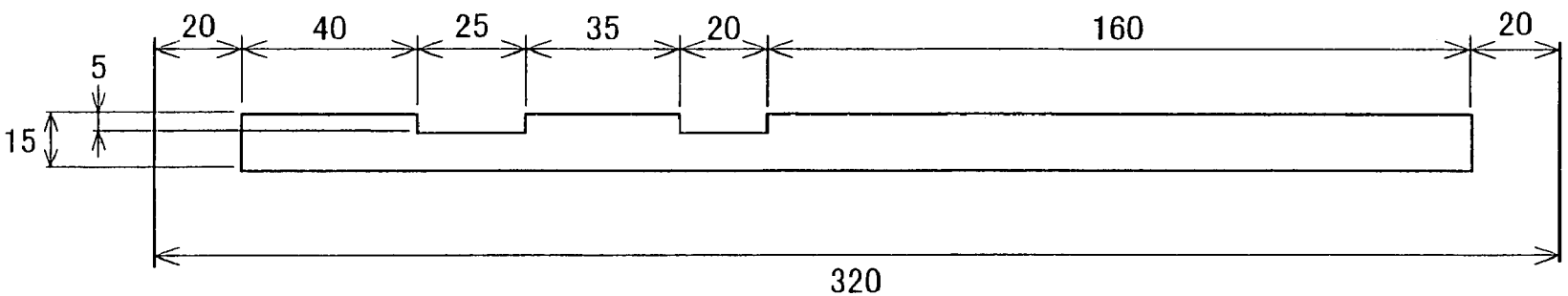
FIG. 4 is a side view of another example of the partition plate.

The partition plate 113 may have more than one cuts from the center section to the end section on the side where the toner supply opening 111*a* is provided. For example, as illustrated in FIG. 4, the partition plate 113 may be provided with two cuts. In this case, the developer has two split flows from a side where the second carrying screw 112*b* is provided to a side where the first carrying screw 112*a* is provided, other than a main flow (a flow that occurs between the partition plate 113 and the developer containing tank 111).

The cut 113*a* does not necessarily have the shape as illustrated in the drawings. For example, the cut 113*a* may be not in a vertical direction but in a slanting direction. Moreover, the cut 113*a* may have a half-moon shape. In a case where a plurality of cuts are provided, an interval between the cuts 113*a* is not limited to the interval mentioned above. Moreover, the plurality of cuts may have different sizes and shapes. It is preferable that the cuts have a larger size towards the end section of the partition plate 113.

In the developing apparatus 103, a toner concentration sensor (toner concentration detecting means) 120 is provided on a downstream side from a center of the first carrying screw 112*a* in the first carrying path C. Thus provided toner concentration sensor 120 can precisely detect a concentration of the toner being agitated. Accordingly, the toner concentration sensor 120 can provide information necessary for realizing supply of stable toner.

(3. Function of Developing Apparatus)

The first carrying screw 112*a* and the second carrying screw 112*b* are rotated by driving means (not shown) in the developer containing tank 111 of the developing apparatus 103. The developer is carried so as to circulate in a direction of a solid line arrow as illustrated in FIG. 1. Specifically, the first carrying screw 112*a* agitates and carries the developer from an upstream side to a downstream side in the first carrying path C. The developer carried to the downstream side of the first carrying path C is carried to the second carrying path D through the first communicating path a. The second carrying screw 112*b* agitates and carries the developer from the upstream side to the downstream side of the second carrying path D (from the downstream side to the upstream side of the corresponding first carrying path C), in the second carrying path D. Namely, the first carrying screw 112*a* and the second carrying screw 112*b* carry the developer in directions opposite to each other, while agitating the developer.

The developer carried to the downstream side of the second carrying path D is returned to the first carrying path C through the cut (communicating opening) 113*a* and the second communicating path b.

In this way, the developer circulates in the first carrying path C and the second carrying path D in the developer containing tank 111, while being agitated.

The developer is supplied with toner at the toner supply opening 111*a* on an upstream side in a direction in which the first carrying screw 112*a* carries the developer. The developer supplied with toner is carried in the first carrying path C and the second carrying path D, while being agitated. The developer is returned to the first carrying path C through two paths including the second communicating path b and the cut 113*a*, and thereby circulates. Because a communicating opening (cut) for the developer is not provided on the partition plate 113 from the center section to the end section on the downstream side of the first carrying path C, the developer does not flow into the second carrying path D in the middle of the first carrying path C. Accordingly, the developer passes all the way through the first carrying path C. After the developer is sufficiently agitated in the first carrying path C and the second carrying path D, the developer is returned to the first carrying path C through a plurality of paths including the second communicating path b and the cut 113*a*. Therefore, the developing apparatus 103 can shorten a time for uniformly mixing the developer. This allows developer agitating performance of the developing apparatus 103 to be improved. Consequently, toner charging performance of the developing apparatus 103 can be improved. As a result, it becomes possible to supply stable toner excellent in electrostatic property to the developing roller 114 from the second carrying screw 112*b*.

Provision of one cut 113*a* on the partition plate 113 makes it possible to shorten a circulation path of the developer and to mix new toner with the developer quickly. Moreover, some developer is returned to the first carrying path C from the second carrying path D through the second communicating path b and other developer is returned through the cut 113*a*. Namely, two (or more) split paths are provided for flow of the developer that is to be returned from the second carrying path D to the first carrying path C. This can improve developer agitating performance of the developing apparatus 103.

Because a cut (communicating opening) 113*a* is provided, a surface of a developer at a position where the cut 113*a* is provided becomes lower than a surface of the developer at a position where a cut is not provided in the second carrying path D. This causes a shortage of developer supply to a developing roller 114 and, consequently, causes a shortage of toner concentration in image formation. However, in the present embodiment, each of the second carrying screw 112*b* and the first carrying screw 112*a* has a larger axis diameter at a position corresponding to positions where the second communicating path b and the cut 113*a* are provided, compared with an axis diameter at a position where the second communicating path b and the cut 113*a* are not provided. This allows to keep an uniform surface height of the developer in the second carrying path D even at the position where the communicating path b and the cut 113*a* are provided, when the developer is returned to the first carrying path C.

Figure 5:
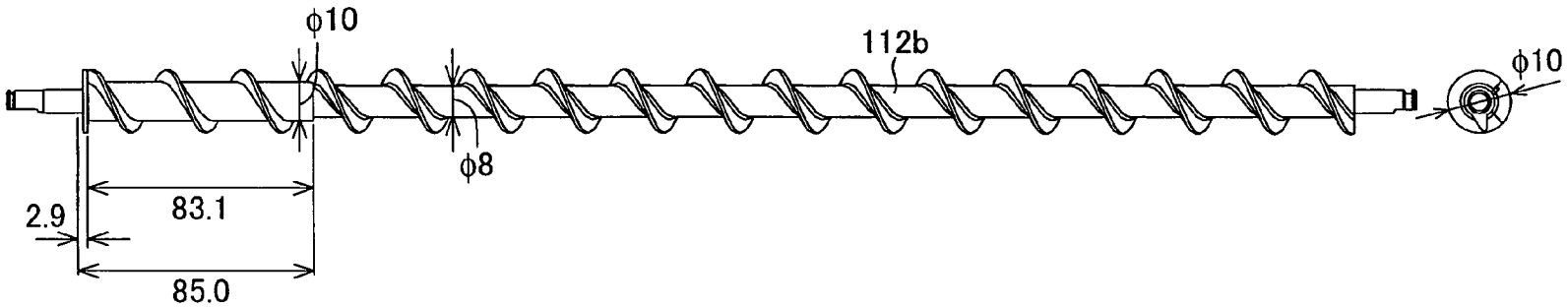
FIG. 5(*a*) is a schematic diagram of a first carrying screw included in the developing apparatus.
Figure 5:
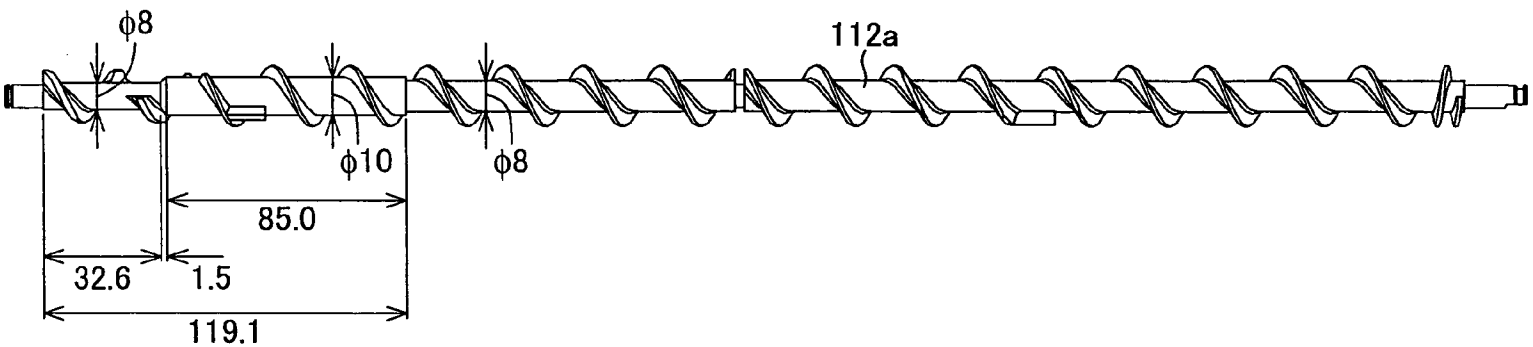

In the present embodiment, as illustrated in FIG. 5(*a*), the second carrying screw 112*b* has a larger axis diameter (screw diameter) at a position corresponding to a position from the end of the cut 113*a* which end is closer to the center section of the partition plate 113 than the other end of the cut 113*a* to the second communicating path b, compared with an axis diameter at a position other than the aforesaid position. Specifically, the second carrying screw 112*b* has a screw diameter of ϕ10 for a 83.1 mm section. This section corresponds to a position from the end of the cut 113*a* to the second communicating path b. The second carrying screw 112*b* has a screw diameter of ϕ8 for a section other than the 83.1 mm section. However, the screw diameter is not limited to this. Moreover, as illustrated in FIG. 5(*b*), the first carrying screw 112*a* also has a larger screw diameter at a position corresponding to a position from the end of the cut 113*a* which end is closer to the center section of the partition plate 113 than the other end of the cut 113*a* to the second communicating path b, compared with a screw diameter at a position other than the aforesaid position. Specifically, the first carrying screw 112*a* has a screw diameter of ϕ10 for a 85.0 mm section on the first carrying screw 112*a*. This section corresponds to a position from the end of the cut 113*a* to the second communicating path b. The first carrying screw 112*a* has a screw diameter of ϕ8 for a section other than the 85.0 mm section. In the Example explained below, a screw diameter was increased at a position corresponding to a position from an end section of the cut 113*a* to a second communicating path b. Alternately, the screw diameter may be increased at a position corresponding to a position from a middle of the cut 113*a* to the second communicating path b. Moreover, in the Example, the screw diameter was from ϕ8 to ϕ10. However, the screw diameter is not limited to this.

The developer barely flows from the first carrying path C to the second carrying path D through the cut 113*a* for the following reason. Because the second carrying path D is provided close to a developing roller, the second carrying path D is narrower to some extent than the first carrying path C. Accordingly, the surface of the developer in the second carrying path D is higher than that in the first carrying path C. Moreover, the cut 113*a* is formed by cutting out an upper section of the partition plate 113. This allows the developer to be returned quickly from the second carrying path D where a surface height of the developer is high to the first carrying path C where a surface height of the developer is low. Therefore, the developer does not flow from the first carrying path C to the second carrying path D.

The first carrying path C is provided on an upstream side thereof with a toner supply opening 111*a*. Toner is supplied from this toner supply opening 111*a* and carried towards a downstream of the first carrying path C. A flow of the developer is carried on in the second carrying path D through the communicating path a. The developer continuously flows from the upstream of the second carrying path D to the downstream of the second carrying path D. Moreover, the second carrying path D is narrower to some extent than the first carrying path C. Therefore, a pressure occurs in a direction from the second carrying path D to the first carrying path C at the downstream of the second carrying path D. Consequently, the developer passes through the cut 113*a* of the partition plate 113 in a direction from the second carrying path D to the first carrying path C.

Due to the agitation and the circulation of the developer as explained above, the developer is evenly distributed in the developer containing tank 111. Moreover, in this agitation, a toner particle and a carrier particle rob each other. This generates electrostatic charge. Consequently, the toner in the developer is charged and attached to a carrier. The toner attached to the carrier all together is attracted to a surface of the developing roller 114 from the second carrying path D. Then, the carrier and the toner attracted to the developing roller 114 are further carried to a position (developing region) where the developing roller 114 comes close to the photoreceptor drum 3. In this developing region, the toner on the developing roller 114 is supplied to the photoreceptor drum 3. In this way, the developing apparatus 103 supplies toner to the photoreceptor drum 3.

In the present embodiment, the end sections of the partition plate 113 in a longitudinal direction thereof is away from the wall surfaces of the developer containing tank 111. This provides the first communicating path a and the second communicating path b to positions where the partition plate 113 is not provided. However, the present invention is not limited to this. For example, the partition plate 113 may be arranged such that the end sections of the partition plate 113 in the longitudinal direction thereof are in contact with the wall surfaces of the developer containing tank 111*a* and provided with cuts at bottom sections as the first communicating path a and the second communicating path b.

Alternately, the partition plate 113 may be arranged such that one of the end sections of the partition plate 113 in the longitudinal direction thereof is in contact with a wall surface of the developer containing tank 111 and provided with a communicating path at a bottom section.

EXAMPLE

Figure 6:
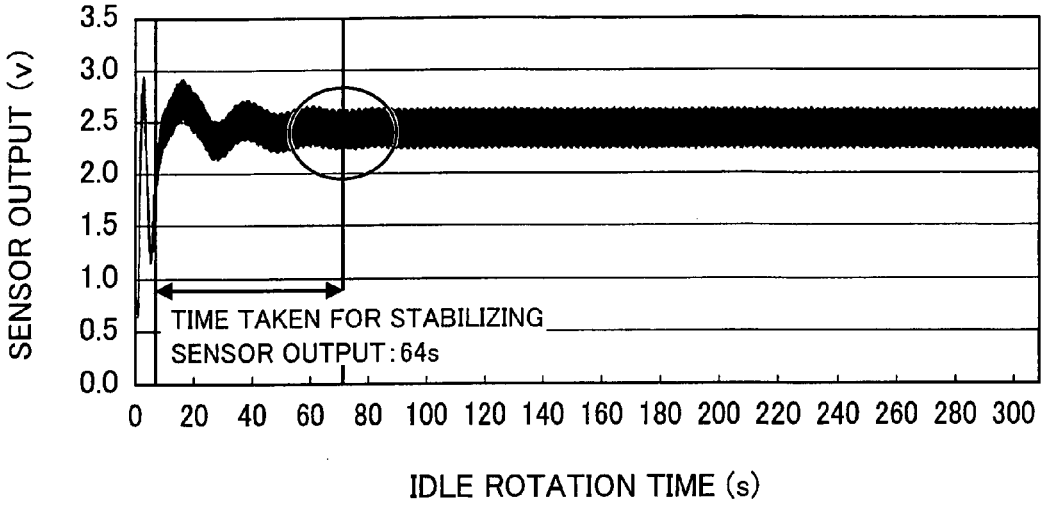
FIG. 6(*a*) is a diagram illustrating an output waveform of a sensor at supply of toner to the developing apparatus in the embodiment of the present invention.
Figure 6:
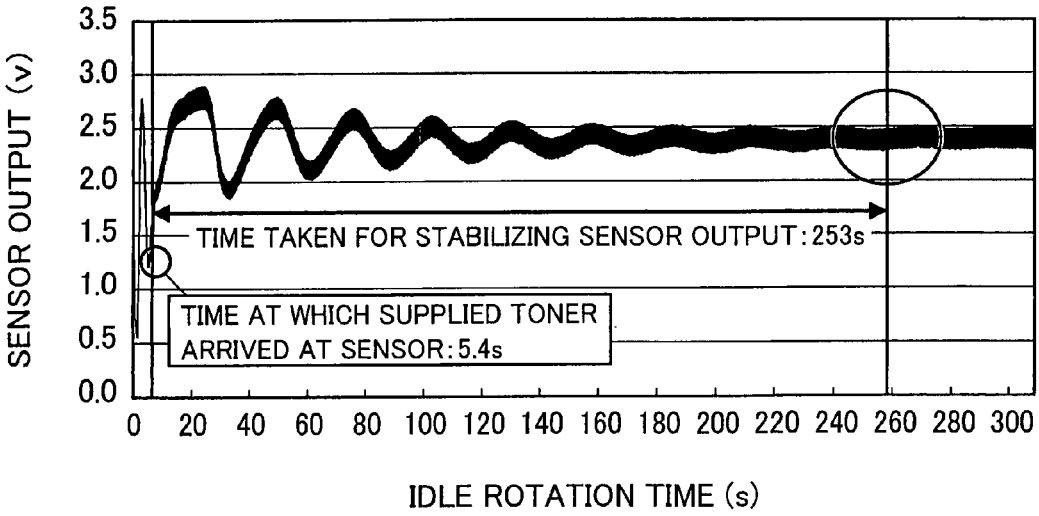

With the developing apparatus 103 of the present invention explained in the Embodiment, developer was agitated and carried by a first carrying screw and a second carrying screw. The input rotation number of the first carrying screw and the second carrying screw was 204 rpm. Under this condition, a speed of mixing a toner and a carrier was examined by measuring an output of a toner concentration sensor 120 in a case where 2.7 g toner was supplied at a time. FIG. 6(*a*) illustrates a result obtained from the sensor output waveform. As illustrated in FIG. 6(*a*), after the toner had arrived at the toner concentration sensor 120, it took 64 seconds until an output of the toner concentration sensor 120 was stabilized.

As a comparative example, a conventional developing apparatus was used. The conventional developing apparatus employed (i) a partition plate without a cut and (ii) a carrying member having a screw diameter of ϕ8. In the conventional developing apparatus, as illustrated in FIG. 6(*b*), after the toner had arrived at the toner concentration sensor 120, it took 253 seconds until an output of the toner concentration sensor 120 was stabilized.

If the toner is mixed quickly, a fluctuation of the waveform deceases quickly. The results explained above show that performance of mixing the developer is improved drastically in the developing apparatus 103 of the present invention, which developing apparatus 103 includes a plurality of flow paths for the developer in the developer containing tank 111 including a partition plate with a cut.

As mentioned above, a developing apparatus of the present invention includes: a developer containing tank, which contains developer containing toner and includes an opening facing an image holder, in which developer containing tank a developer holder is rotatably provided at a position facing the opening; first and second agitating and carrying members provided parallel to the developer holder in the developer containing tank, the first and second agitating and carrying members agitating and carrying the developer in directions opposite to each other; and a partition member, provided between the first and the second agitating and carrying members, which partitions an inside of the developer containing tank so as to form (i) a first carrying path where the first agitating and carrying member carries the developer and (ii) a second carrying path where the second agitating and carrying member carries the developer, the first and second carrying paths communicating each other through communicating paths provided at end sections of the first and second carrying paths, and circulating the developer between the first and second carrying paths, the first agitating and carrying member having in its vicinity a toner supply opening, through which toner is supplied, on an upstream side in a direction to which the first agitating and carrying member carries the developer, the first agitating and carrying member being provided farther from the developer holder than the second agitating and carrying member, the partition member including one or more communicating openings, provided from a center section in a longitudinal direction to an end section on a side where the toner supply opening is provided, which communicating opening returns the developer from the second carrying path to the first carrying path, and the developer being returned from the second carrying path to the first carrying path, through the communicating path and the one or more communicating openings.

In the developing apparatus of the present invention, in addition to the arrangement mentioned above, the one or more communicating openings may be provided by cutting out an upper section of the partition member.

In the developing apparatus, the second carrying path is provided close to the developing roller. The second developing path is narrower to some extent than the first carrying path. Therefore, a surface of the developer in the second carrying path becomes higher than that in the first carrying path. Moreover, the one or more communicating openings are provided by cutting out an upper section of the partition member. Consequently, the developer can be quickly returned from the second carrying path having a high surface height of the developer to the first carrying path having a low surface height of the developer. According to this arrangement, the one or more communicating openings can be easily formed by cutting out the upper section of the partition member. Furthermore, the developer can be effectively circulated by returning the developer from the second communicating path to the first communicating path through the cut provided at the upper section of the partition member.

In the developing apparatus of the present invention, in addition to the arrangement mentioned above, the communicating openings may have a larger size towards an end of the partition member.

According to the arrangement, the communicating openings have a larger size towards an end of the partition member. Accordingly, an amount of the developer passing through the communicating openings becomes larger towards the end of the partition member. Namely, the closer to the end of the partition member the developer is, the more the developer flows into the first carrying path from the second carrying path. This increases an amount of the developer that is agitated for a long distance in the first and second carrying paths. This improves developer agitating performance of the developing apparatus.

In the developing apparatus of the present invention, in addition to the arrangement mentioned above, the partition member may be away from side walls at ends of the first and second carrying paths in the longitudinal direction.

According to the arrangement, the partition member is away from the side walls at ends of the first carrying path and the second carrying path in the longitudinal direction. This arrangement makes it possible to easily form the communicating paths through which the developer is carried between the first and second carrying paths.

In the developing apparatus of the present invention, in addition to the above mentioned arrangement, each of the first and second agitating and carrying members may be a screw having a larger axis diameter at a position corresponding to positions where the communicating path and the one or more communicating openings for returning the developer from the second carrying path to the first carrying path are provided, compared with an axis diameter of the screw at a position that does not correspond to the positions where the communicating path and the one or more communicating openings are provided.

Due to provision of a communicating opening, in a second carrying path, a surface of developer at a position where the communicating opening is provided becomes lower than a surface of the developer at a position where the communicating opening is not provided. Therefore, a shortage of toner concentration occurs in image formation, due to a shortage in supply of the developer to the developing roller. According to the arrangement mentioned above, an axis diameter of the screw at a position corresponding to positions where the communicating path and the one or more communicating openings is provided is larger than an axis diameter of the screw at a position that does not correspond to the positions where the communicating path and the one ore more communicating openings are provided. This makes it possible to keep the surface of the developer in the second carrying path uniform even at the position corresponding to the positions where the communicating path and the one or more communicating openings are provided when the developer flows into the first carrying path. This can realize image development in which an even and stable image quality is maintained.

In the developing apparatus of the present invention, in addition to the above mentioned arrangement, toner concentration detecting means may be provided in the first carrying path on a downstream side with respect to a center section of the first agitating and carrying member.

According to the arrangement, the concentration of the toner being agitated is precisely detected. Accordingly, it becomes possible to obtain information necessary for supplying stable toner.

In the developing apparatus of the present invention, in addition to the above mentioned arrangement, the second carrying path may be narrower than the first carrying path.

A second carrying path is narrower than a first carrying path. Therefore, a surface of developer in the second carrying path becomes higher than that in the first carrying path. However, according to the arrangement, the provision of the one or more communicating openings formed by cutting out an upper section of the partition member allows the developer to be quickly returned to the first carrying path having a low surface height of the developer from the second carrying path having a high surface height. This prevents flow of the developer from the first carrying path to the second carrying path.

An image forming apparatus of the present invention, as mentioned above, includes: a developing apparatus; and a toner containing tank for supplying toner to a toner supply opening of the developing apparatus.

According to the arrangement, the developing apparatus can provide stable toner excellent in electrostatic property quickly. This makes it possible to form a high quality image at a high speed.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

The present invention is applicable to a developing apparatus in which toner is carried and circulated, which developing apparatus is included in an image forming apparatus such as a copying apparatus or a printer.

What is claimed is:

1. A developing apparatus comprising:

a developer containing tank, which contains developer containing toner and includes an opening facing an image holder, and in which a developer holder is rotatably provided at a position facing the opening;

first and second agitating and carrying members provided parallel to the developer holder in the developer containing tank, the first and second agitating and carrying members agitating and carrying the developer in directions opposite to each other;

a partition member, provided between the first and the second agitating and carrying members, which partitions an inside of the developer containing tank so as to form (i) a first carrying path where the first agitating and carrying member carries the developer in a longitudinal direction of the first carrying path and (ii) a second carrying path where the second agitating and carrying member carries the developer in a longitudinal direction of the second carrying path, the developer flowing in directions opposite to each other in the longitudinal directions of the first and second carrying paths; and toner concentration detecting means provided in the first carrying path on a downstream side with respect to a center section of the first agitating and carrying member in the flow of the developer carried in the longitudinal direction of the first carrying path, the first and second carrying paths communicating each other through communicating paths provided at end sections of the first and second carrying paths, and circulating the developer between the first and second carrying paths, the first agitating and carrying member having in its vicinity a toner supply opening, through which toner is supplied, on an upstream side in the flow of the developer carried by the first agitating and carrying member in the longitudinal direction of the first carrying path, the first agitating and carrying member being provided farther from the developer holder than the second agitating and carrying member, the partition member including a plurality of communicating openings, provided from a center section in a longitudinal direction to an end section on a side where the toner supply opening is provided, which communicating openings return the developer from the second carrying path to the first carrying path, the developer being returned from the second carrying path to the first carrying path, through the communicating path and the communicating openings, and the plurality of communicating openings becoming larger toward the end section of the partition member on a side where the toner supply opening is provided.

2. The developing apparatus as set forth in claim 1, wherein the one or more communicating openings are provided by cutting out an upper section of the partition member.

3. The developing apparatus as set forth in claim 2, wherein the second carrying path is narrower than the first carrying path.

4. The developing apparatus as set forth in claim 1, wherein the partition member is away from side walls at ends of the first and second carrying paths in the longitudinal direction.

5. The developing apparatus as set forth in claim 1, wherein each of the first and second agitating and carrying members is a screw having a larger axis diameter at a position corresponding to positions where the communicating path and the one or more communicating openings for returning the developer from the second carrying path to the first carrying path are provided, compared with an axis diameter of the screw at a position that does not correspond to the positions where the communicating path and the one or more communicating openings are provided.

6. An image forming apparatus comprising:

a developing apparatus; and a toner containing tank for supplying toner to a toner supply opening of the developing apparatus, said developing apparatus comprising:

a developer containing tank, which contains developer containing toner and includes an opening facing an image holder, and in which a developer holder is rotatably provided at a position facing the opening;

first and second agitating and carrying members provided parallel to the developer holder in the developer containing tank, the first and second agitating and carrying members agitating and carrying the developer in directions opposite to each other;

a partition member, provided between the first and the second agitating and carrying members, which partitions an inside of the developer containing tank so as to form (i) a first carrying path where the first agitating and carrying member carries the developer in a longitudinal direction of the first carrying path and (ii) a second carrying path where the second agitating and carrying member carries the developer in a longitudinal direction of the second carrying path, the developer flowing in directions opposite to each other in the longitudinal directions of the first and second carrying paths; and toner concentration detecting means provided in the first carrying path on a downstream side with respect to a center section of the first agitating and carrying member in the flow of the developer carried in the longitudinal direction of the first carrying path, the first and second carrying paths communicating each other through communicating paths provided at end sections of the first and second carrying paths, and circulating the developer between the first and second carrying paths, the first agitating and carrying member having in its vicinity the toner supply opening, through which toner is supplied, on an upstream side in the flow of the developer carried by the first agitating and carrying member in the longitudinal direction of the first carrying path, the first agitating and carrying member being provided farther from the developer holder than the second agitating and carrying member, the partition member including a plurality of communicating openings, provided from a center section in a longitudinal direction to an end section on a side where the toner supply opening is provided, which communicating openings return the developer from the second carrying path to the first carrying path, the developer being returned from the second carrying path to the first carrying path, through the communicating path and the plurality of communicating openings, and the plurality of communicating openings becoming larger toward the end section of the partition member on a side where the toner supply opening is provided.

* * * * *